United States Patent [19]

Sakuma et al.

[11] Patent Number: 4,775,007

[45] Date of Patent: Oct. 4, 1988

[54] HEAT EXCHANGER FOR AN AIR-CONDITIONING APPARATUS

[75] Inventors: Kiyoshi Sakuma; Yoshiaki Tanimura; Hiroyuki Umemura; Makoto Yamada, all of Shizuoka; Yu Seshimo; Masao Fujii, both of Amagasaki; Ikuo Tsukamoto, Shizuoka, all of Japan

[73] Assignee: Mitsubishi Denki Kabushiki Kaisha, Tokyo, Japan

[21] Appl. No.: 70,629

[22] Filed: Jul. 7, 1987

Related U.S. Application Data

[63] Continuation of Ser. No. 835,646, Mar. 3, 1986, abandoned.

[30] Foreign Application Priority Data

Mar. 17, 1985 [JP] Japan ..... 60-45254
May 24, 1985 [JP] Japan ..... 60-111707

[51] Int. Cl.[4] ..... F28D 1/04

[52] U.S. Cl. ..... 165/151; 165/182; 165/908

[58] Field of Search ..... 165/151, 181, 182, 908

[56] References Cited

U.S. PATENT DOCUMENTS

| | | | |
|---|---|---|---|
| 3,796,258 | 3/1974 | Mathotra et al. | 165/151 |
| 3,889,745 | 6/1975 | Siemonsen | 165/151 |
| 3,902,551 | 9/1975 | Lin et al. | 165/151 X |
| 4,480,684 | 11/1984 | Onishi et al. | 165/110 |

FOREIGN PATENT DOCUMENTS

| | | | |
|---|---|---|---|
| 2947271 | 6/1981 | Fed. Rep. of Germany | 165/151 |
| 0140253 | 10/1979 | Japan | 165/151 |
| 59-26408 | 12/1984 | Japan . | |
| 68620 | 4/1915 | Switzerland | 165/151 |
| 457000 | 11/1936 | United Kingdom | 165/151 |
| 700960 | 12/1953 | United Kingdom | 165/151 |
| 1174402 | 12/1969 | United Kingdom . | |
| 1476079 | 6/1977 | United Kingdom . | |
| 1544927 | 4/1979 | United Kingdom . | |

*Primary Examiner*—Michael Koczo
*Assistant Examiner*—Peggy Neils
*Attorney, Agent, or Firm*—Murray and Whisenhunt

[57] ABSTRACT

A heat exchanger comprises a plurality of regularly corrugated fins placed one over another in layers at regular pitches in a back-to-back arrangement so as to form alternate wide and narrow fluid passage between the adjacent corrugated fins, and each having a plurality of small through holes, a plurality of collars formed in a staggered arrangement, and an annular area not having any small through hole and formed so as to surround the root of each collar; and pipes for passing a secondary fluid therethrough, each inserted through the collars of the layers of the corrugated fins. The height of the collar from the lower surface of the annular area corresponds to the pitch between the adjacent corrugated fins, and thereby the corrugated fins can be assembled at regular pitches simply by placing one over another. The pipes are expanded after being inserted through the collars so that the pipes are firmly and closely joined to the collars for satisfactory heat transmission between the fins and the pipes.

6 Claims, 4 Drawing Sheets

HEAT EXCHANGER FOR AN AIR-CONDITIONING APPARATUS

This application is a continuation of Ser. No. 835,646, filed Mar. 3, 1986, now abandoned.

BACKGROUND OF THE INVENTION

The present invention relates to the constitution of a heat exchanger for an air-conditioning apparatus.

FIG. 10 illustrates the constitution of a heat exchanger disclosed in Japanese Patent Application No. 59-264087. This heat exchanger comprises corrugated fins 1 arranged in layers and each having a plurality of through holes 13 and trapezoidal corrugations, and pipes 2 disposed so as to disturb fluid flows which flow in a direction indicated by an arrow Z through fluid passages formed between the layers of the corrugated fins 1. In the heat exchanger shown in FIG. 10, the corrugated fins 1 are arranged so that the ridges and the furrows of one of the adjacent corrugated fins 1 are disposed opposite the furrows and the ridges of the other, respectively.

FIG. 8 is a sectional view of assistance in explaining the function of the heat exchanger of FIG. 10. Referring to FIG. 8, suppose that a first fluid passage 51 and a second fluid passage 52 are formed between the fins 1*a* and 1*b* and between the fins 1*b* and 1*c*, and that the flow rate and the total pressure of the primary fluid, such as air, that flows through the first fluid passage 51 are the same as those of the primary fluid that flows through the second fluid passage 52. Then, in a plane corresponding to line X—X perpendicular to the direction of the fluid flow indicated by an arrow Z, the first fluid passage 51 and the second fluid passage 52 are different from each other in sectional area, more specifically, the sectional area of the first fluid passage 51 is greater than that of the second fluid passage 52. Accordingly, the velocity of the primary fluid across the cross section of the first fluid passage 51 corresponding to line X—X is smaller than that across the cross section of the second fluid passage 52 corresponding to line X—X, and hence the static pressure of the primary fluid in the first fluid passage 51 in the vicinity of the cross section is higher than that of the primary fluid in the second fluid passage 52 in the vicinity of the corresponding cross section. Consequently, part of the primary fluid flowing through the first fluid passage 51 flows through the through holes 13 into the second fluid passage 52. With particular reference to the fin 1*b*, part of the primary fluid flows alternately from the primary fluid passage 51 into the second fluid passage 52, and from the second fluid passage 52 into the first fluid passage 51, through the through holes 13 formed in the fin 1*b*, according to the arrangement to the corrugations of the fin 1*b*. This arrangement of the corrugated fins 1 forms fluid passages each having a sequential arrangement of planes for uniform suction and those for uniform blowing, which are arranged along the direction of the flow of the primary fluid. In the section for uniform suction, since the thickness of boundary layers formed over the heat transmitting surfaces is very small, the heat transmission promoting effect is enhanced remarkably, while in the section for uniform blowing, the same high heat transmission promoting effect is provided by the effect of the repetition of accelerating sections. Furthermore, in the stagnation region behind the pipe 2, the primary fluid is able to flow from one to the other fluid passage through the through holes 13 without stagnating in the stagnation region, and thereby the heat transmitting characteristics of the portion in the vicinity of the stagnation region of the heat exchanger is improved. Thus, the inventor of the heat exchanger disclosed in Japanese Patent Application No. 59-264087 states that the invention provides a heat exchanger capable of very high heat transmitting performance which has never been expected.

The inventor states also that the heat exchanger of his invention is provided with continuous fins not having any edge which causes a profile drag, instead of divided fins which utilizes edge effect for disturbing the flow of the primary fluid for improved heat transmission, and hence the pressure loss of the flow of the primary fluid is reduced remarkably.

In Japanese Patent Application No. 59-264087, only the performance of the heat exchanger, such as improvement in heat transmitting performance and reduction in pressure loss, is stated, however, nothing is mentioned regarding measures of manufacturing the heat exchanger, such as the manner of arranging the fins in layers and the manner of joining the pipes to the fins. Furthermore, since the pipes for passing a secondary fluid therethrough have a circular cross section, the overall sectional area of the fluid passages is reduced.

SUMMARY OF THE INVENTION

Accordingly, it is an object of the present invention to provide a heat exchanger capable of the above-mentioned excellent heat transmitting performance and of being efficiently manufactured.

It is another object of the present invention to provide a heat exchanger provided with pipes for passing the secondary fluid therethrough, having a cross section other than a circular cross section, capable of the same heat exchanging efficiency as a pipe having a circular cross section, and capable of increasing the overall sectional area of the fluid passage for passing the primary fluid therethrough.

The above and other objects, features and advantages of the present invention will become more apparent from the following description of the preferred embodiments taken in conjunction with the accompanying drawings.

DESCRIPTION OF THE PREFERRED EMBODIMENTS

Figure 1:
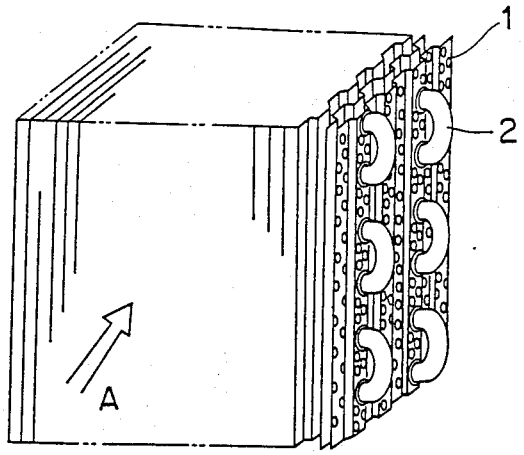
FIG. 1 is a perspective view of a heat exchanger embodying the present invention.
Figure 2:
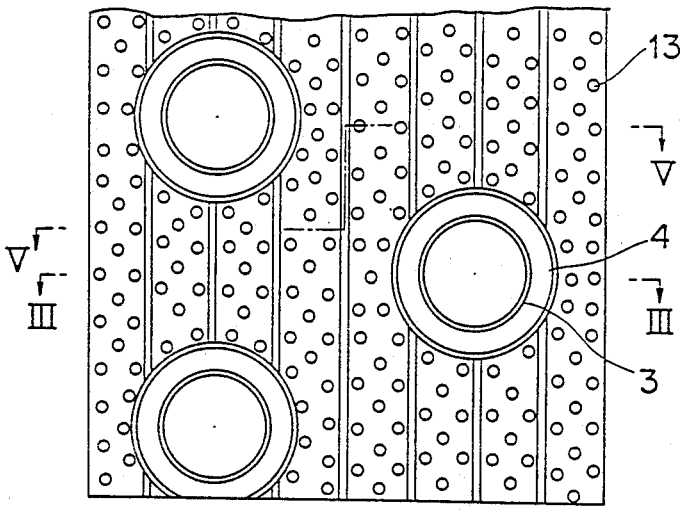
FIG. 2 is a sectional plan view of a heat exchanger, in a first embodiment, according to the present invention, taken on a plane parallel to one of the fins thereof.
Figure 3:
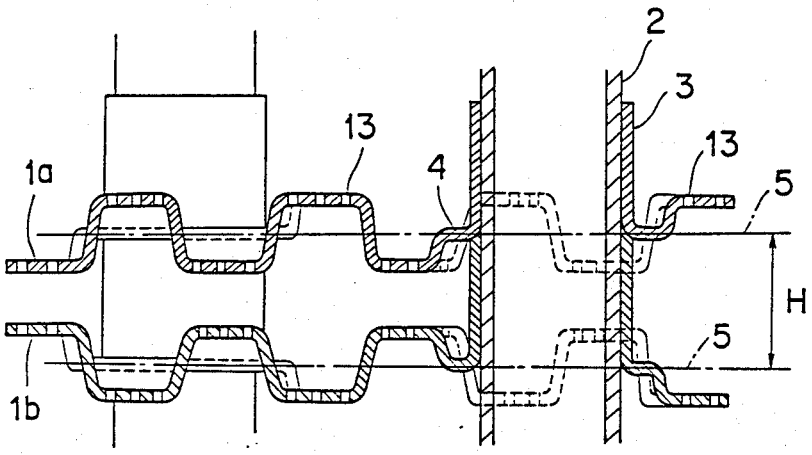
FIG. 3 is a fragmentary sectional view taken on line III—III in FIG. 2.
Figure 4:
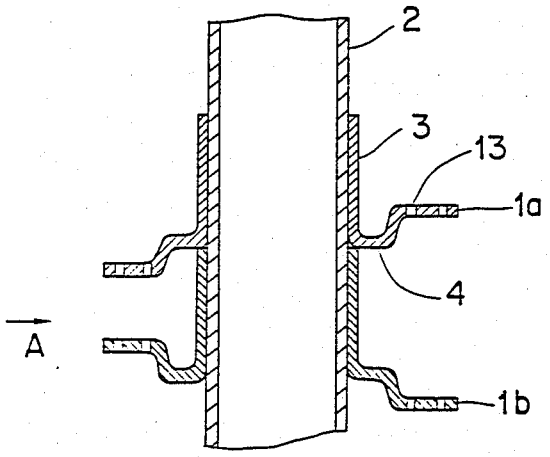
FIG. 4 is a sectional view illustrating a junction of a fin and a pipe.

Referring to FIGS. 1 to 5, a heat exchanger, in a first embodiment, according to the present invention comprises corrugated fins 1 provided with a plurality of through holes 13 and arranged in layers, and pipes 2 joined to the corrugated fins 1. A collar 3 is formed at each junction of the fin 1 and the pipe 2. An annular area 4 surrounds the collar 3, and no through holes are formed in the annular area 4. The fin 1 is corrugated so that the ridges and furrows thereof extend perpendicularly to the direction of flow of a primary fluid. The height H of the collar 3 corresponds to the pitch of the fins 1, namely, the distance between the respective pitch planes 5 of the adjacent fins 1. The annular area 4 and the collar 3 are formed by pressing so that the root of the collar 3 is on the pitch plane 5.

The height H of the collar 3, the height of the ridge of the fin 1 and the depth of the furrow of the fin 1 are decided with reference to the annular area 4. The annular area 4 serves as a reinforcement in forming the collar 3. The fins are placed one over the other with the lower surface of the annular area 4 of the upper fin, for example, a fin 1*a* in FIG. 3, in abutment with the upper end of the collar 3 of the lower fin, for example a fin 1*b* in FIG. 3. Thus, the fins are placed one over another at regular pitches corresponding to the height H of the collar 3. After the fins 1 have thus been assembled in layers, pipes 2 are inserted through the collar 3, and then the pipes 2 are expanded so that pipes 2 are joined closely to the corresponding collars 3 for satisfactory heat transmission therebetween. Thus the fins 1 are assembled in layers automatically at predetermined regular pitches simply by placing one over another.

The performance of this heat exchanger will be described with reference to FIG. 5, however, since the improved performance of the heat exchanger of the present invention is practically the same as that of the heat exchanger disclosed in Japanese Patent Application No. 59-264087, the detailed description thereof will be omitted.

Figure 5:
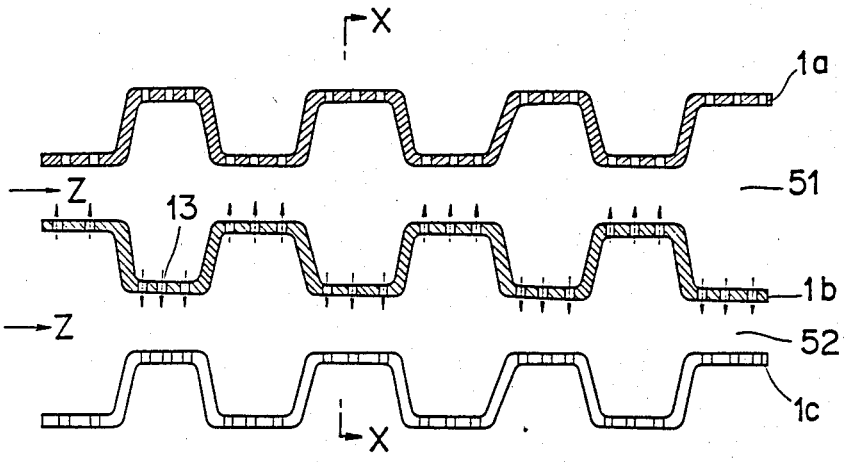
FIG. 5 is a sectional view taken on line V—V in FIG. 2.
Figure 7:
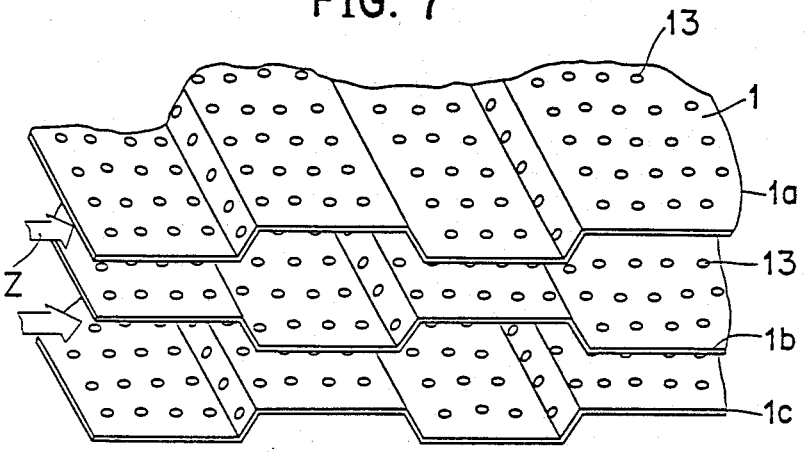
FIG. 7 is a perspective view illustrating an arrangement of fins in a heat exchanger embodying the present invention.
Figure 8:
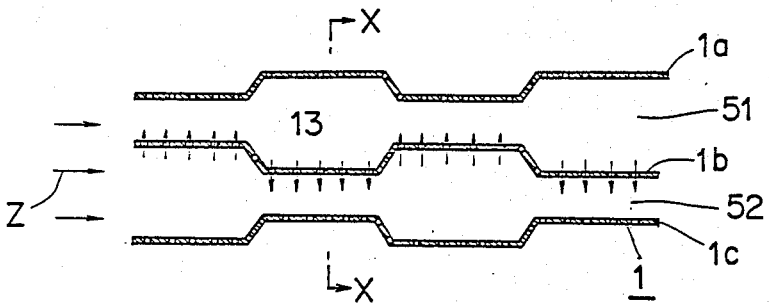
FIG. 8 PRIOR ART
FIG. 8 is a schematic sectional view of assistace in explaining the function of perforated corrugated fins arranged in layers.

Referring to FIG. 5, a first fluid passage 51 and a second fluid passage 52 are formed between the fins 1*a* and 1*b* and between the fins 1*b* and 1*c*, respectively. Suppose that the flow rate and the total pressure of the primary fluid that flows through the first fluid passage 51 and those of the primary fluid that flows through the second fluid passage are the same. Then, in a plane corresponding to line X—X perpendicular to the direction of the fluid flow indicated by arrows Z, the first fluid passage 51 and the second fluid passage 52 are different from each other in sectional area, more specifically, the sectional area of the first fluid passage 51 is greater than that of the second fluid passage 52. Accordingly, the velocity of the primary fluid across the cross section of the first fluid passage 51 corresponding to line X—X is smaller than that across the cross section of the second fluid passage 52 corresponding to line X—X. Consequently, in the vicinity of the plane corresponding to line X—X, part of the primary fluid flowing through the first fluid passage 51 flows through the through holes 13 into the second fluid passage 52 due to the difference between the first fluid passage 51 and the second fluid passage 52 in static pressure, and hence the thickness of the boundary layer over the heat transmitting surface of the section for uniform suction is reduced to a very small value, and thereby the heat transmission promoting effect is enhanced remarkably. In the blowing surface, the effect of repetition of accelerating sections provides high heat transmitting performance. As regards the stagnation of the primary fluid in the region behind the pipe 2, since the annular area 4 is small and the fin 1 is corrugated, the stagnation of the primary fluid in the region behind the pipe 2 is negligible. Furthermore, since the primary fluid flows between the adjacent fluid passages through the through holes 13, the heat transmitting characteristics of the heat exchanger in the region behind the pipe 2 is improved.

Figure 6:
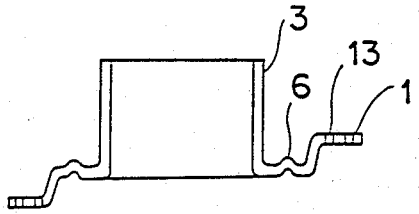
FIG. 6 is a fragmentary sectional view of a fin employed in a heat exchanger, in a second embodiment, according to the present invention.

FIG. 6 illustrates a portion of a corrugated fin employed in a heat exchanger, in a second embodiment, according to the present invention. This corrugated fin 1 is provided with an annular protrusion formed around a collar 3 in the annular area 4. This annular protrusion 6 further reinforces the fin 1 against stress which is produced in the fin 1 in forming the collar 3 and also prevents the stagnation of the primary fluid in the region behind the pipe 2.

Figure 9:
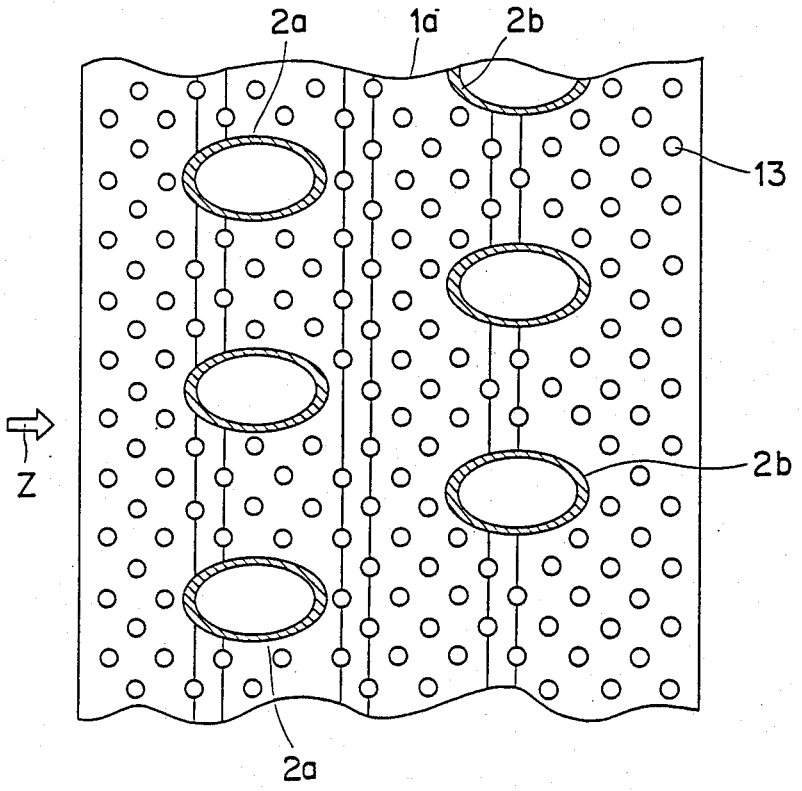
FIG. 9 is a sectional plan view of a heat exchanger, in a third embodiment, according to the present invention.
Figure 10:
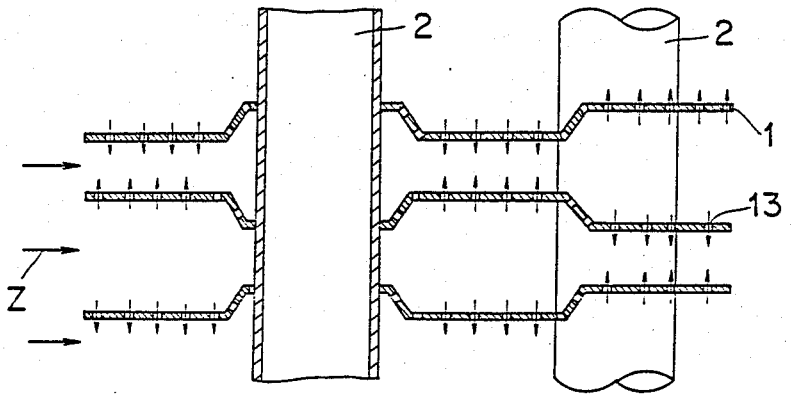
FIG. 10 PRIOR ART
FIG. 10 is a fragmentary sectional view of a conventional heat exchanger.

FIG. 9 illustrates a portion of a heat exchanger, in a third embodiment, according to the present invention. This heat exchanger is provided with pipes 2 each having an elliptic cross section and the same surface area as that of the pipe 2 having a circular cross section. The pipe 2 is disposed with its major axis in parallel to the direction of flow of the primary fluid indicated by an arrow Z. Therefore, the width of the fluid passage, namely, the distance between the adjacent pipes 2*a* aligned along a line extending perpendicularly to the direction of flow of the primary fluid and between the adjacent pipes 2*b* aligned along a line extending perpendicularly to the direction of flow of the primary fluid, is greater than that between the corresponding pipes each having a circular cross section, such as employed in the first and second embodiments. Thus, the pipes each having an elliptic cross section prevents the generation of turbulent flow behind the pipes and reduces the pressure loss of the primary fluid. Accordingly, the heat exchanger has the same heat exchanging area as those of the heat exchangers in the first and second embodiments and is capable of operating with less pressure loss and less tubulent flow therein.

Although the invention has been described in its preferred forms with certain degree of particularity, it is to be understood that many changes and variations are possible in the invention without departing from the scope and spirit thereof.

What is claimed is:

1. A heat exchanger, comprising:

a plurality of regularly corrugated fins placed one over another in layers at regular pitches in a back-to-back arrangement, each corrugated fin having a series of ridges and furrows, each ridge of a corrugated fin having a top disposed in a first plane and each furrow of a corrugated fin having a bottom disposed in a second plane parallel to said first plane, each corrugated fin having a plurality of small through holes which allow a primary fluid to flow therethrough from a first fluid passage formed between adjacent corrugated fins into an adjacent fluid passage formed between adjacent corrugated fins and from said adjacent fluid passage into said first fluid passage;

a plurality of collars disposed in a staggered arrangement;

an annular area surrounding each collar and having a lower surface disposed in a third plane, said third plane being parallel to and positioned centrally between said first and second planes, each annular area being devoid of any small through holes;

a plurality of pipes for passing a secondary fluid therethrough, each pipe passing through said collars and extending perpendicularly to planes containing the fluid passages formed between adjacent corrugated fins;

each said collar extending from said annular area and having a height from said lower surface of said annular area corresponding to said pitch between adjacent corrugated fins.

2. A heat exchanger according to claim 1, wherein said corrugated fins are formed by pressing, and said pipes are expanded after being inserted through said collars so that said pipes are firmly and closely joined to said collars.

3. A heat exchanger according to claim 1, wherein each pipe has a circular cross-section.

4. A heat exchanger according to claim 1, wherein each pipe has an elliptical cross-section.

5. A heat exchanger according to claim 1, wherein an annular protrusion is formed in said annular area concentrically with said collar.

6. A heat exchanger according to claim 1, wherein said collar extends at right angles to said annular area

* * * * *